US011279595B2

(12) United States Patent
Raassina et al.

(10) Patent No.: US 11,279,595 B2
(45) Date of Patent: Mar. 22, 2022

(54) DOOR OPERATING ARRANGEMENT IN AN ELEVATOR

(71) Applicant: KONE Corporation, Helsinki (FI)

(72) Inventors: Pasi Raassina, Helsinki (FI); Ari-Pekka Lahtinen, Helsinki (FI)

(73) Assignee: KONE CORPORATION, Helsinki (FI)

( * ) Notice: Subject to any disclaimer, the term of this patent is extended or adjusted under 35 U.S.C. 154(b) by 993 days.

(21) Appl. No.: 15/971,415

(22) Filed: May 4, 2018

(65) Prior Publication Data

US 2018/0339884 A1 Nov. 29, 2018

(30) Foreign Application Priority Data

May 29, 2017 (EP) ..... 17173307

(51) Int. Cl.

*B66B 13/02* (2006.01)
*B66B 13/24* (2006.01)
*B66B 13/14* (2006.01)

(52) U.S. Cl.

CPC ..... *B66B 13/02* (2013.01); *B66B 13/143* (2013.01); *B66B 13/24* (2013.01)

(58) Field of Classification Search

CPC ..... B66B 13/143; B66B 13/02; B66B 13/24
USPC ..... 187/316
See application file for complete search history.

(56) References Cited

U.S. PATENT DOCUMENTS

2003/0089556 A1 5/2003 Eilinger
2015/0053507 A1 2/2015 Kattainen et al.
2018/0339884 A1* 11/2018 Raassina ..... B66B 13/02
2019/0097551 A1* 3/2019 Nagarajan ..... H02P 3/26
2020/0189883 A1* 6/2020 Dwari ..... B66B 11/0226

FOREIGN PATENT DOCUMENTS

| | | | | |
|---|---|---|---|---|
| CN | 1057624 | A | 1/1992 | |
| CN | 2438698 | Y | 7/2001 | |
| CN | 102666350 | A | 9/2012 | |
| CN | 104379479 | A | 2/2015 | |
| ES | 2320094 | T3 | 5/2009 | |
| JP | 2002-68632 | A | 3/2002 | |
| JP | 2005-104608 | A | 4/2005 | |
| JP | 2005-253300 | A | 9/2005 | |
| JP | 2007-76900 | A | 3/2007 | |
| WO | WO 2011/053294 | A1 | 5/2011 | |
| WO | WO-2017189418 | A1 * | 11/2017 | ..... H02H 7/085 |

OTHER PUBLICATIONS

European Search Report issued in EP 17 17 3307, dated Nov. 2, 2017.

* cited by examiner

*Primary Examiner* — Jeffrey Donels
(74) *Attorney, Agent, or Firm* — Birch, Stewart, Kolasch & Birch, LLP

(57) ABSTRACT

A door operating arrangement in an elevator, including a door operating unit located in the elevator car including a door controller and a door drive as well as a door motor configured to open and close elevator car doors, optionally together with elevator landing doors, a DC bus connecting the door operating unit via a travelling cable of the elevator car with a DC power source of the elevator. The voltage level of the DC bus is between 40 V and 120 V, the DC bus is connected to a capacitor bank located in the elevator car having a parallel connection of at least two capacitors and a total capacity value of at least 75.000 μF, preferably at least 100.000 μF.

18 Claims, 1 Drawing Sheet

DOOR OPERATING ARRANGEMENT IN AN ELEVATOR

BACKGROUND OF THE INVENTION

1. Field of Invention

The present invention relates to a door operating arrangement in an elevator.

2. Description of the Background Art

Usually, the door operating arrangement in an elevator comprises a door operating unit located in the elevator car comprising a door controller and a door drive as well as a door motor configured to open and close the elevator car doors and in most cases also the elevator landing doors in connection with the elevator car doors. The door operating unit in the elevator car is connected with a DC power source of the elevator via a DC bus which is connected to the elevator car via a travelling cable. The door operating unit regularly comprises an AC door motor and the door drive comprises a frequency converter which has an inverter bridge to provide an AC current of desired frequency to drive the door motor with a desired speed ramp during the door opening/closing process. A problem is that in emergency cases, for example in case of mains power off, the elevator car door and the landing door have to be opened manually at the end of a rescue drive. This requires at least an operator on site which is familiar with the process of performing a rescue drive and which is able to manually open the landing doors and car doors.

SUMMARY OF THE INVENTION

It is therefore object of the present invention to provide a door operating arrangement in an elevator which allows the proper function of the door operating unit also in emergency situations, for example in the case of mains power off.

The object of the invention is solved with a door operating arrangement and with an elevator. Preferred embodiments of the invention are subject-matter of the dependent claims. Preferred embodiments of the invention are also mentioned in the specification as well as in the drawings.

The door operating arrangement according to the invention comprises a door operating unit located in the elevator car comprising a door controller and a door drive which is controlled by the door controller as well as a door motor which is driven by the door drive and which is configured to open and close the elevator car doors. In most cases, the door motor simultaneously opens and closes the landing doors connecting the floors with the elevator shaft.

Furthermore, the door operating arrangement comprises a DC bus connecting the door operating unit via a travelling cable of the elevator car with a DC power source of the elevator. According to a preferred embodiment of the invention, the voltage level of the DC bus is between 40 V and 60 V, preferably between 50 V and 60 V. Furthermore, the DC bus is connected to a capacitor bank located in the elevator car having a parallel connection of at least two capacitors and a total capacity value of at least 75.000 μF, preferably at least 100.000 μF.

According to the invention, the voltage level of the DC bus is set to a DC level which is as high as possible, but which is safe in handling. Thus, the voltage level of 60 V builds a kind of safety barrier for a quite unrestricted use of a DC voltage without extended safety measures. Thus, the voltage level of the DC bus should be as near to this safety barrier of 60 V as possible. Preferably, the voltage is higher than 45 V, preferably higher than 50 V and most preferably in the range between 55 V and 60 V. In some embodiments the voltage level of the DC bus may be even higher than 60 V, for example 110V, if more energy is required for operating the doors. In this case, however, the uprising electrical safety issues have to be taken into consideration.

Via the high voltage of the DC bus and the exorbitantly high capacity value of the capacitor bank, the capacitor bank stores a power that is sufficient to open the elevator car doors even in the case that the DC power source of the elevator should break down. Thus, the elevator car doors may also be opened when no power is available from the DC power source of the elevator. This feature also enables automatic rescue operations where a rescue drive may be monitored and operated by a remote monitoring center. Thus, not also the rescue drive can be performed via a remote location but also the opening of the car doors and landing doors can be initiated by the remote monitoring center via a remote controlled switch in the elevator control. The present invention also showed that the common understanding that the door operator peak power is so high that a DC voltage supply is not suitable for this purpose does not hold true. In former times, a 230 V AC was needed to drive the door operating unit. The present invention has now a higher safety level as no high voltage supply lines have to be provided for the door operating unit and on the other hand via the capacitor bank with its high energy storing capacity the operation of the door operating unit has become independent of the power supply. Thus, the invention is quite independent of disturbances, fluctuations or drops of the mains power supply.

In a preferred embodiment of the invention, the distance from the capacitor bank to the door operating unit is no longer than 1 m, preferably no longer than 50 cm. As the capacitor bank is able via the energy stored in the capacitors to output a high current to the door operating unit quite thick cables has to be used for that connection. On the other hand, this high current may affect electric components thereby. Therefore, it is preferable to minimize the distance for the high current transmission between the capacitor bank and the door operating unit.

In a preferred embodiment of the invention, the capacitor bank is located on a same circuit board as the door drive. This means that all high power components of the door arrangement are located in a short distance on one circuit board which minimizes the whole space required for the heavy duty components and which on the other side minimizes the emission of electromagnetic noise. Alternatively, the capacitor bank may be a separate unit installed to the elevator car. The distance from the capacitor bank to the door operating unit could also be longer than 1 m, if the capacitor bank is mounted for example to the car roof.

Preferably, the capacity value of the capacitor bank is between 100.000 μF and 300.000 μF, particularly between 120.000 μF and 200.000 μF. It has been found that already with a total capacity value of 100.000 μF, a sufficient operation of the door operating unit can be achieved. Of course, if the capacity value is chosen higher, this gives sufficient reserve power for the operating unit so that the operating unit may even be operated 5 minutes after a mains power off in which time the capacitor bank is able to hold the stored energy. Thus, the value of the capacitor bank may be a little bit higher than necessary to perform a reliable operation but it should not be too high because of costs and because of the in that case unnecessary large space requirement for the comparably large electrolyte capacitors.

In a preferred embodiment of the invention, the DC power source of the elevator is a DC link of a frequency converter of a motor drive of the elevator. Nowadays, the elevators use AC synchronous or asynchronous motors which are fed by a frequency converter. The frequency converter comprises a DC link between the rectifier bridge connected with mains and the inverter bridge connected with the AC motor. This DC link is an adapted location to act as a DC power source for the door operating unit, whereby usually the voltage level of this DC link is several 100 V.

Preferably, fixed in the building, preferably in connection with the elevator control or motor drive of the elevator, a DC-module is located comprising a DC converter converting the voltage of the DC power source, for example the DC link of the frequency converter of the motor drive of the elevator, on its primary side to a DC voltage on its secondary side between 40 V and 60 V, preferably between 50 V and 60 V. The voltage in the DC link of a motor drive is typically in the area of several hundred volts. Thus, this voltage cannot be used for the DC bus. The DC converter is an appropriate means to convert the high level voltage of the DC link to an appropriate voltage level for the DC bus for the door operating unit.

In some embodiments, the DC power source supplying the DC bus is dimensioned to appx. 10%, preferably between 5% and 20%, of the peak power demand of the door operating unit.

In a preferred embodiment of the invention, the DC converter is at its secondary side connected to a smoothing circuit which smoothens any remaining voltage ripple in the DC bus before going into the travelling cable for the elevator car. This minimizes any noise emission by the travelling cable.

Preferably, the door motor is an AC motor with an operating voltage of 18 to 60 V which is adapted for its function as a door motor. The door drive preferably comprises an inverter bridge connected with the phases of the door motor on one hand and with the capacitor bridge on the other hand, which inverter bridge is controlled by the door controller. With this arrangement, the speed of the door motor can be adjusted to a required speed curve during the opening and closing movement of the door.

Preferably, the door controller comprises a rescue circuit for opening the elevator car doors and optionally the landing doors in an abnormal operating situation via a switch located in connection with the elevator car and/or the elevator control panel. This switch could also be a switch in the elevator control panel which can be operated by a remote monitoring location. With this means, the elevator car doors and optionally also the landing doors can be operated even in case of power off and after a rescue drive where the elevator car is driven manually or with an automatic rescue drive operation to a nearby landing. Then, the doors can be operated automatically via the switch either by an operator on site or via an operator at the remote monitoring location. This enables an automatic freeing of trapped passengers after a rescue ride. Instead of switch, another sensors such as door zone sensor could be used to initiate door opening, when the door zone sensor detects that elevator car has arrived to the door zone.

The invention also refers to an elevator comprising a door arrangement as disclosed above.

It should be clear for the skilled person that the above-mentioned embodiments may be combined with each other arbitrarily.

BRIEF DESCRIPTION OF THE DRAWING

The invention will hereinafter be described in connection with the enclosed drawing.

DETAILED DESCRIPTION OF THE PREFERRED EMBODIMENTS

Figure 1:
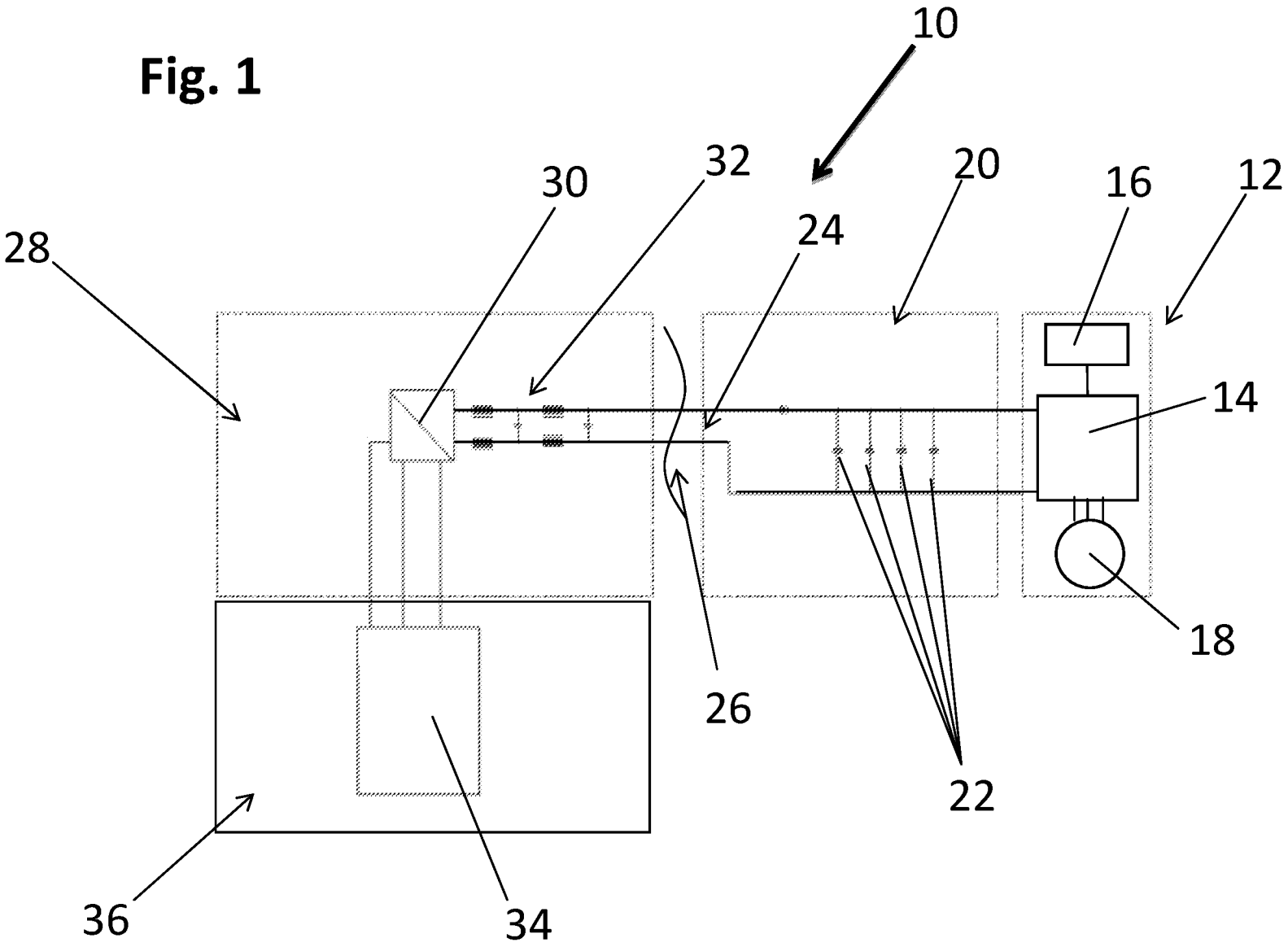
FIG. 1 is a schematic diagram of an inventive door operating arrangement.

The inventive door operating arrangement 10 comprises a door operating unit 12 comprising a door drive 14, for example an inverter bridge, which door drive 14 is controlled by a door controller 16 and which door drive 14 is connected with the phases of a door motor 18 which is preferably an AC motor with an operating range of 18 to 60 V. Connected to the door operating unit 12 is a capacitor bank 20 comprising four capacitors 22 connected in parallel which capacitor bank has a total capacity value of at least 75.000 μF, preferably at least 100.000 μF, most preferably between 120.000 μF and 200.000 μF. This leaves enough energy for the operation of the door operating unit even a certain time after power off of the DC power source of the elevator. The capacitor bank 20 is connected to a DC bus 24 which is running in the travelling cable 26 of the elevator car where it is connected with a DC module 28 comprising a DC converter 30 to which the DC bus 26 is connected via a smoothing circuit 32. The smoothing circuit 32 comprises inductances and capacitors in a per se known arrangement to minimize any voltage ripple in the DC bus 24. The DC converter 30 of the DC module 28 is connected to a DC link 34 of the frequency converter of a motor drive 36 of the elevator.

The voltage level in the DC bus 24 is preferably between 50 V and 60 V, most preferably between 55 V and 60 V. 60 V forms for a DC voltage a kind of safety barrier above which additional safety measures have to be taken which again make the solution more expensive. On the other hand, the voltage in the DC bus should go as near to this limit value of 60 V as possible as the power stored in the capacitor bank 20 is characterized by a product of the total capacity value with the square of the voltage in the DC bus. The DC link 34 in the frequency converter of the motor drive 36 has usually a DC voltage level of several hundred volts which is converted by the DC converter 30 to the above-mentioned appropriate level of 40 to 60 V, preferably 50 to 60 V, most preferably 55 to 60 V.

During normal operation, the advantage of the present invention is that the peak power of the door operating unit 12 when the motor 18 is started to run can be supplied by the capacitor bank. This results in the fact that the current drawn from the DC power source, i.e. the DC link 34, does not show any high peaks which make the control of the DC power consumption difficult. On the other hand, this solution has the advantage that in case of mains power off, when no DC voltage can be provided by the DC link 34, the power stored in the capacitor bank is high enough to enable one door operation to open the elevator car doors as well as the landing doors after a rescue drive. Thus, the invention enables an automatic releasing of trapped passengers after a power fault of the AC mains.

One advantage of the invention is that capacitor bank endures much more charging/discharging cycles than for example a battery. Therefore an increased lifetime may be achieved compared to a battery implementation.

The above-mentioned embodiments do not restrict the scope of protection of the invention as apparent from the appended patent claims. It is to be mentioned that the smoothing circuit 32 between the DC converter 30 and the travelling cable 26 is optional and not necessary to carry out the invention. It is further necessary to mention that the capacitor bank does not need four parallel capacitors as mentioned in the figures but even one single capacitor may be sufficient to provide the necessary capacity value but for practical reasons it is better to provide the necessary total capacity by a parallel connection of several capacitors which saves space and which is also more economical than one super-capacitor which is comparably expensive. Anyway, the invention can also be realized with one super-capacitor having a capacity value of more than 70.000 μF.

LIST OF REFERENCE NUMBERS

10 door operating arrangement
12 door operating unit
14 door drive
16 door controller
18 door motor
20 capacitor bank
22 capacitors
24 DC bus
26 traveling cable of the elevator car
28 DC module
30 DC converter
32 smoothing circuit
34 DC link of the motor drive of the elevator motor—DC power source of the elevator
36 motor drive

The invention claimed is:

1. A door operating arrangement in an elevator, comprising:

a door operating unit located in an elevator car of the elevator, the door operating unit including:

a door controller;

a door motor configured to open and close car doors of the elevator car, the door motor being an AC motor with an operating range of 18V to 60V; and a door drive, wherein the door drive comprises an inverter bridge connected with phases of the door motor, the inverter bridge being controlled by the door controller;

a DC bus directly electrically connected to the door drive to connect the door operating unit with a DC power source of the elevator, the DC bus running in a travelling cable of the elevator car;

a DC module; and a capacitor bank connected directly between the DC module and the door operating unit and provided in the elevator car, the capacitor bank having a parallel connection of at least two capacitors and a total capacity value of at least 75,000 μF, wherein the voltage level of the DC bus is more than 40 V, and wherein the DC bus is connected to the capacitor bank.

2. The door operating arrangement according to claim 1, wherein the voltage level of the DC bus is between 40V and 120 V.

3. The door operating arrangement according to claim 1, wherein the distance from the capacitor bank to the door operating unit is no longer than 1 m.

4. The door operating arrangement according to claim 1, wherein the capacitor bank is located on a same circuit board as the door drive.

5. The door operating arrangement according to claim 1, wherein the voltage level of the DC bus is between 40 V and 60 V.

6. The door operating arrangement according to claim 1, wherein the capacity value of the capacitor bank is between 100.000 μF and 300,000 μF.

7. The door operating arrangement according to claim 1, wherein the DC power source is a DC link of a frequency converter of a motor drive of the elevator.

8. The door operating arrangement according to claim 1, wherein the DC module is fixed in a building and comprises a DC converter converting the voltage of the DC power source on a primary side thereof to a DC voltage on a secondary side thereof between 40V and 120 V.

9. The door operating arrangement according to claim 8, wherein the DC converter is at the secondary side connected to a smoothing circuit.

10. The door operating arrangement according to claim 1, wherein the door controller comprises a rescue circuit for operating the elevator car door and optionally the landing doors in abnormal operating situations via a switch located in connection with the elevator car and/or the elevator control panel.

11. An elevator comprising the door arrangement according to claim 1.

12. The door operating arrangement according to claim 1, wherein the voltage level of the DC bus is between 50V and 120 V.

13. The door operating arrangement according to claim 1, wherein the voltage level of the DC bus is between 55V and 120 V.

14. The door operating arrangement according to claim 1, wherein the distance from the capacitor bank to the door operating unit is no longer than 50 cm.

15. The door operating arrangement according to claim 1, wherein the voltage level of the DC bus is between 50 V and 60 V.

16. The door operating arrangement according to claim 1, wherein the voltage level of the DC bus is between 55 V and 60 V.

17. The door operating arrangement according to claim 1, wherein the capacity value of the capacitor bank is between 120,000 and 200,000 μF.

18. The door operating arrangement according to claim 1, wherein the DC module is fixed in a building and comprises a DC converter converting the voltage of the DC power source on a primary side thereof to a DC voltage on a secondary side thereof between 40V and 60 V.

* * * * *